US009016291B2

(12) United States Patent
Kelle et al.

(10) Patent No.: US 9,016,291 B2
(45) Date of Patent: Apr. 28, 2015

(54) SYSTEM FOR STORING AND DISPENSING LIQUID CLEANING ADDITIVE FOR A HIGH-PRESSURE CLEANING APPLIANCE

(75) Inventors: Stefan Kelle, Heidelberg (DE); Michael Boehm, Sulzbach (DE); Ralph Seitter, Backnang (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 1225 days.

(21) Appl. No.: 12/806,059

(22) Filed: Aug. 3, 2010

(65) Prior Publication Data

US 2011/0023918 A1 Feb. 3, 2011

Related U.S. Application Data

(63) Continuation of application No. PCT/EP2009/000894, filed on Feb. 5, 2009.

(30) Foreign Application Priority Data

Feb. 6, 2008 (DE) ..... 10 2008 009 221

(51) Int. Cl.
*B08B 3/00* (2006.01)
*B08B 3/02* (2006.01)

(52) U.S. Cl.
CPC ..... *B08B 3/026* (2013.01); *B08B 2203/0217* (2013.01)

(58) Field of Classification Search
CPC ..... B08B 2203/007; B08B 2203/0217
USPC ..... 134/99.2, 100.1, 105
See application file for complete search history.

(56) References Cited

U.S. PATENT DOCUMENTS 4,173,858 A * 11/1979 Cassia ..... 53/471
4,679,271 A 7/1987 Field et al.

(Continued)

FOREIGN PATENT DOCUMENTS

DE 33 09 967 9/1984
DE 87 16 072 2/1988

(Continued)

OTHER PUBLICATIONS

Patent Abstracts of Japan, Abstract of Japanese Patent "Tire Wear Detecting Device and Method", Publication No. 2006151269, Jun. 16, 2006, Japanese Application No. 2004346910, Filed Nov. 30, 2004.

*Primary Examiner* — David Cormier
(74) *Attorney, Agent, or Firm* — Lipsitz & McAllister, LLC

(57) ABSTRACT

A system for storing and dispensing a liquid cleaning additive for a high-pressure cleaning appliance has a device for storing the cleaning additive and a device for dispensing the cleaning additive in a controlled manner. In order to develop the system such that it is easier to handle, it is proposed that the storage device has an intermediate tank, which is fixedly held on the high-pressure cleaning appliance, and an independently handlable refill container for filling the intermediate tank, it being possible for liquid cleaning additive to be withdrawn in a controlled manner from said intermediate tank by means of the dispensing device, it being possible for the refill container to be secured on the high-pressure cleaning appliance and to be flow-connected to the intermediate tank, cleaning additive flowing automatically out of the refill container into the intermediate tank upon withdrawal of cleaning additive from the intermediate tank, in order to maintain a predetermined liquid level in the intermediate tank. A refill container for such a system and also a high-pressure cleaning appliance having such a system are also proposed.

33 Claims, 5 Drawing Sheets

(56) References Cited

U.S. PATENT DOCUMENTS

| | | | | |
|---|---|---|---|---|
| 4,846,236 | A | 7/1989 | Deruntz | |
| 5,174,730 | A | 12/1992 | Nieuwkamp et al. | |
| 5,421,489 | A * | 6/1995 | Holzner, Sr. et al. | 222/207 |
| 5,455,979 | A | 10/1995 | Bores et al. | |
| 5,735,620 | A | 4/1998 | Ford | |
| 5,922,968 | A | 7/1999 | Briscoe | |
| 5,940,928 | A | 8/1999 | Erko | |
| 6,006,388 | A * | 12/1999 | Young | 8/158 |
| 6,095,370 | A * | 8/2000 | Rhine et al. | 222/1 |
| 6,123,122 | A | 9/2000 | Dushman | |
| 6,142,750 | A | 11/2000 | Benecke | |
| 6,493,896 | B1 | 12/2002 | Stuchlik et al. | |
| 6,971,549 | B2 * | 12/2005 | Leifheit et al. | 222/83 |
| 7,992,245 | B2 | 8/2011 | Schuetz et al. | |
| 8,011,050 | B2 | 9/2011 | Knopow | |
| 8,015,650 | B2 | 9/2011 | Knopow et al. | |
| 2003/0043039 | A1 | 3/2003 | Salemi et al. | |
| 2003/0070697 | A1 * | 4/2003 | Field et al. | 134/102.1 |
| 2004/0045581 | A1 | 3/2004 | Boomgaarden et al. | |
| 2005/0110639 | A1 | 5/2005 | Puzio et al. | |
| 2006/0069463 | A1 | 3/2006 | Kim | |
| 2006/0103523 | A1 | 5/2006 | Field | |
| 2006/0265824 | A1 | 11/2006 | Knopow | |
| 2007/0020040 | A1 | 1/2007 | Sacks | |
| 2008/0047092 | A1 | 2/2008 | Schnittman et al. | |
| 2008/0073375 | A1 * | 3/2008 | Nelson et al. | 222/129 |
| 2008/0099045 | A1 | 5/2008 | Glenn et al. | |
| 2008/0136664 | A1 | 6/2008 | Elsasser et al. | |
| 2008/0178909 | A1 | 7/2008 | Alvestig et al. | |
| 2008/0218312 | A1 | 9/2008 | Asher et al. | |
| 2008/0276969 | A1 * | 11/2008 | Vanantwerp et al. | 134/25.1 |
| 2009/0058617 | A1 | 3/2009 | Wu et al. | |
| 2010/0011212 | A1 | 1/2010 | Anemikos et al. | |
| 2010/0045423 | A1 | 2/2010 | Glickman et al. | |
| 2010/0236141 | A1 | 9/2010 | Chen et al. | |
| 2010/0325826 | A1 | 12/2010 | Knopow et al. | |

FOREIGN PATENT DOCUMENTS

| | | |
|---|---|---|
| DE | 38 41 177 | 11/1990 |
| DE | 91 04 336 | 7/1991 |
| DE | 94 01 950 | 3/1994 |
| DE | 195 21 536 | 12/1996 |
| DE | 696 08 116 | 1/2001 |
| DE | 10 2004 019 888 | 2/2005 |
| DE | 10 2004 022 359 | 11/2005 |
| DE | 601 11 306 | 3/2006 |
| DE | 10 2005 041 598 | 1/2007 |
| DE | 699 37 015 | 5/2008 |
| DE | 60 2005 004 218 | 1/2009 |
| DE | 10 2007 050 351 | 4/2009 |
| EP | 0 444 031 | 9/1991 |
| EP | 0 504 568 | 9/1992 |
| EP | 0 649 626 | 4/1995 |
| EP | 0 844 030 | 5/1998 |
| EP | 1 118 300 | 7/2001 |
| EP | 1 927 408 | 6/2008 |
| JP | 2000-217759 | 8/2000 |
| WO | 2007/143214 | 12/2007 |

* cited by examiner

SYSTEM FOR STORING AND DISPENSING LIQUID CLEANING ADDITIVE FOR A HIGH-PRESSURE CLEANING APPLIANCE

This application is a continuation of international application number PCT/EP2009/000894 filed on Feb. 5, 2009 and claims the benefit of German application no. 10 2008 009 221.5 filed on Feb. 6, 2008.

The present disclosure relates to the subject matter disclosed in international application number PCT/EP2009/000894 of Feb. 5, 2009 and German application number 10 2008 009 221.5 of Feb. 6, 2008, which are incorporated herein by reference in their entirety and for all purposes.

BACKGROUND OF THE INVENTION

The invention relates to a system for storing and dispensing a liquid cleaning additive for a high-pressure cleaning appliance, having a device for storing the cleaning additive and having a device for dispensing the cleaning additive in a controlled manner for mixing with the cleaning liquid of the high-pressure cleaning appliance.

The invention also relates to a refill container for such a system and to a high-pressure cleaning appliance having such a system.

With the aid of high-pressure cleaning appliances, a cleaning liquid, preferably water, can be subjected to pressure and then directed onto an article which is to be cleaned. For this purpose, the high-pressure cleaning appliance has a drive motor which drives a pump in order to deliver the cleaning liquid. In order to increase the cleaning action, it is possible for the cleaning liquid, in the case of some high-pressure cleaning appliances, to be heated. For this purpose, the high-pressure cleaning appliances have a heatable heat exchanger, for example coiled tubing, which is heated by a burner and through which the cleaning liquid is channeled. In the case of such heatable high-pressure cleaning appliances, a liquid cleaning additive in the form of a descaler is admixed with the cleaning liquid in order to counteract the build-up of limescale on subassemblies of the high-pressure cleaning appliance, in particular on the heat exchanger.

In order to increase the cleaning action, it is also known for a liquid cleaning additive in the form of a cleaning chemical, for example a soap solution, to be admixed with the cleaning liquid.

The operation of admixing liquid cleaning additives takes place, in many cases, with the aid of injectors which are connected into the flow path of the pressurized cleaning liquid and via which the liquid cleaning additive, for example a cleaning chemical, is taken in.

It is also known to have configurations of high-pressure cleaning appliances in which a liquid cleaning additive is admixed with the aid of an electromagnetic metering valve.

For the purpose of storing the liquid cleaning additive, the known high-pressure cleaning appliances have a storage tank which can be filled from the outside and from which the liquid cleaning additive can be withdrawn via a draw-off line, this liquid cleaning additive then being admixed with the pressurized cleaning liquid, for example by means of an injector.

It is an object of the present invention to develop a system for storing and dispensing a liquid cleaning additive, of the type mentioned in the introduction, for a high-pressure cleaning appliance, such that it is easier for the user to handle.

SUMMARY OF THE INVENTION

This object is achieved according to the invention, in the case of a system for storing and dispensing a liquid cleaning additive of the generic type, wherein the storage device has an intermediate tank, which is fixedly held on the high-pressure cleaning appliance, and an independently handlable refill container for filling the intermediate tank, it being possible for liquid cleaning additive to be withdrawn in a controlled manner from the intermediate tank by means of the dispensing device, and it being possible for the refill container to be secured on or in the high-pressure cleaning appliance and flow-connected to the intermediate tank, cleaning additive flowing automatically out of the refill container into the intermediate tank upon draw-off of cleaning additive from the intermediate tank, in order to maintain a predetermined liquid level in the intermediate tank.

In the case of the storage and dispensing system according to the invention, the liquid cleaning additive, for example a cleaning chemical or a descaling solution, can be introduced into an intermediate tank from a refill container. The intermediate tank is fixedly disposed on or in the high-pressure cleaning appliance and, by means of the dispensing device, the liquid cleaning additive can be drawn off in a controlled manner from the intermediate tank and admixed with the cleaning liquid of the high-pressure cleaning appliance. The intermediate tank thus forms a first storage tank for cleaning additive. The refill container used forms a second storage tank since, as long as it is not completely empty, it remains on the high-pressure cleaning appliance, to which it can be secured. It serves for refilling the intermediate tank continuously as required. The intermediate tank may thus have a constant liquid level. This makes it easier for cleaning additive to be withdrawn in a controlled manner from the intermediate tank. Furthermore, the volume of the intermediate tank can be kept comparatively low since the refill container, which can be secured on the high-pressure cleaning appliance and forms a structural unit which can be handled independently, provides the system according to the invention with a large volume for supplying liquid cleaning additive.

By virtue of liquid cleaning additive flowing continuously as required out of the refill container into the intermediate tank, the intermediate tank can remain filled until the refill container has been emptied. Thereafter, the refill container can be exchanged by the user, although this exchange need not necessarily take place whenever the refill container is empty. Rather, the intermediate tank provides a kind of "buffer volume" which makes it possible for the user to operate the high-pressure cleaning appliance, with the admixture of liquid cleaning additive to the cleaning liquid, even when the refill container is already empty. The refill container can thus be completely emptied by the user without the user then immediately having to have a new refill container to hand. Rather, the initially still full intermediate tank provides a sufficient quantity of liquid cleaning additive, so that, even when the refill container is emptied, proper operation of the high-pressure cleaning appliance is still possible for a certain period of time.

It is advantageous if the storage device has a holder with a base which comprises a filling opening via which the intermediate tank can be filled with cleaning additive and which is surrounded by an opening periphery and in which a connection nozzle is disposed, and if the refill container comprises an outlet nozzle and can be inserted into the holder, it being possible for the outlet nozzle to be positioned on the connection nozzle with an inner annular space being formed between the connection nozzle and the outlet nozzle and an outer annular space being formed between the outlet nozzle and the opening periphery. Such a configuration readily ensures that, upon withdrawal of liquid cleaning additive from the intermediate tank, a corresponding quantity of cleaning additive can flow out of the refill container into the intermediate tank. The flow connection between the refill container and the intermediate tank takes place via a filling opening which is disposed on the base of a holder, a connection nozzle being positioned in the filling opening. The refill container has an outlet nozzle which can be positioned on the connection nozzle when the refill container is positioned on the holder. The outlet nozzle of the refill container here surrounds the connection nozzle, that is to say the connection nozzle penetrates into the outlet nozzle. The internal diameter of the outlet nozzle is selected to be greater than the external diameter of the connection nozzle, so that an inner annular space is formed between the connection nozzle and the outlet nozzle. The external diameter of the outlet nozzle, in turn, is selected to be smaller than the internal diameter of the opening periphery, so that an outer annular space is formed between the outlet nozzle and the opening periphery. The two annular spaces are in flow connection with the intermediate tank via the filling opening. It has been found that such a configuration makes it possible for cleaning additive to flow uniformly out of the refill container and, at the same time, for air to flow into the refill container, to be precise until the intermediate tank, following withdrawal of cleaning additive, is completely filled again. The flow of liquid cleaning additive out of the refill container into the intermediate tank here takes place automatically without there being any need to use a delivery device, for example a pump. The outflow of cleaning additive in a quantity corresponding to that drawn off from the intermediate tank takes place under the action of gravity.

It is advantageous if the connection nozzle has, at its end which is directed toward the refill container, a cutting edge for cutting through a film material or membrane which closes the connection nozzle of the refill container. Such a configuration allows particularly straightforward handling of the system. The initially full refill container has a container opening in the form of an outlet nozzle, which is sealed closed by a film material or a membrane. The refill container can then be secured on the holder in an upended state, that is to say with its outlet nozzle directed vertically downward, the outlet nozzle being positioned on the connection nozzle. The connection nozzle has, at its end which is directed toward the refill container, a cutting edge. The latter cuts through the film material when the outlet nozzle reaches the end of the connection nozzle. The operation of inserting the refill container into the holder is thus very straightforward, without there being any risk of a large quantity of liquid cleaning additive flowing out of the refill container and contaminating the holder.

The end of the connection nozzle preferably runs obliquely in relation to the longitudinal axis of the connection nozzle. This makes it easier to cut through the film material disposed on the outlet nozzle and furthermore, has the advantage that it is easier for liquid cleaning additive to flow out of the refill container. This is because it has been found that the oblique end of the connection nozzle facilitates the outflow of the liquid cleaning additive. This is probably because the oblique configuration of the connection nozzle facilitates the exchange of air between the interior of the refill container and the outside atmosphere.

In order to avoid the situation where particles of dirt can pass in relatively large quantities into the intermediate tank, it is advantageous if the connection nozzle is surrounded by a first screen. The first screen thus delimits the outer annular space, which is provided between the connection nozzle and the opening periphery of the filling opening. The screen may have, for example, a mesh width of 0.5 to 2 mm, in particular a mesh width of 1 mm.

It is advantageous if the connection nozzle comprises a second screen, that is to say if a second screen is disposed within the connection nozzle or at the end of the connection nozzle. The mesh width of this second screen may likewise be 0.5 mm to 2 mm, in particular a mesh width of 1 mm may be provided.

In the case of a particularly preferred configuration, the second screen is offset in the direction of the refill container in relation to the first screen. The second screen may be disposed, in particular, at that end of the connection nozzle which is directed toward the refill container, whereas the first screen may be disposed level with that end of the connection nozzle which is directed away from the refill container. The offset arrangement of the two screens makes it easier for liquid cleaning additive to flow uniformly out of the refill container into the intermediate tank, since it is possible for an air cushion to form beneath the second screen, that is to say within the connection nozzle, and it is possible for air bubbles to rise up from the air cushion into the refill container while, at the same time, liquid cleaning additive can flow out of the refill container via the inner annular space.

It is advantageous if the holder has disposed in it an insert which has a first screen that can be inserted into the filling opening and on which the connection nozzle is held. The insert can be connected preferably in a releasable manner to the holder, so that it can be removed by the user in order for the holder to be cleaned. The insert forms the first screen and also has the connection nozzle, which is surrounded in the circumferential direction by the first screen. As already explained, the connection nozzle may have a second screen. If the screens are blocked, then the entire insert can easily be removed from the holder and then cleaned by the user.

It is advantageous if the insert can be latched to the holder. For example, it is possible for the holder to have, in the region of the filling opening, at least one first latching element, in particular a latching receiver, and for the insert to have at least one second latching element, in particular a latching protrusion, which interact in a latching manner with one another when the insert is inserted into the holder.

The insert is preferably of trough-like configuration and comprises a trough periphery which is directed toward the refill container and on which the refill container can be supported. The trough-like configuration has the advantage that cleaning additive which exits accidentally out of the refill container can collect in the insert. The cleaning additive which exits accidentally can thus be disposed of by the insert being removed. Moreover, on account of its trough periphery directed toward the refill container, the insert constitutes a support on which the refill container can be supported. The refill container can thus be positioned on the trough periphery of the insert.

Preferably at least one tap-off opening is disposed on the base of the holder, and the insert has at least one discharge opening interacting with the tap-off opening. In the case of such a configuration, cleaning additive which passes accidentally into the insert can flow out of the holder via the discharge opening of the insert and the tap-off opening at the base of the holder.

It is advantageous if the discharge opening is formed by a discharge nipple which penetrates into the tap-off opening in the base of the holder. The discharge nipple can engage through the tap-off opening.

No more detail has been given up until now in respect of the design of the holder. In a particularly preferred embodiment, the storage and dispensing system according to the invention comprises a holder in the form of an accommodating well with a well wall and a well base, the filling opening being disposed on the well base and it being possible for the refill container to be inserted into the accommodating well by way of a container opening which is directed toward the filling opening, said refill container engaging against the well wall at least in certain regions. Providing an accommodating well into which the refill container can be inserted makes it easier to secure the refill container on the high-pressure cleaning appliance. All that is required is for the user to insert the refill container in an upended state into the accommodating well, so that the container opening is directed toward the filling opening at the base of the well. The accommodating well can, for all practical purposes, fully enclose the refill container in the circumferential direction, so that, even in the case of vibratory movement of the high-pressure cleaning appliance, the refill container cannot accidentally swing back and forth or even slide out of the accommodating well. Rather, provision of the accommodating well makes it possible for the refill container to be easily secured in a reliable manner on the high-pressure cleaning appliance. Reliable securing, moreover, has the advantage that, during operation of the high-pressure cleaning appliance, the situation where liquid cleaning additive flows accidentally out of the refill container can be avoided.

It is advantageous if the refill container inserted into the accommodating well is retained in the accommodating well with its container opening oriented downward and such that it cannot be displaced transversely to the vertical. In the case of such a configuration, it is thus no longer possible for the refill container to be moved in the accommodating well transversely to the vertical.

For this purpose, the refill container can establish a positive lock with the accommodating well.

The accommodating well preferably comprises a supporting surface, on which the refill container can be supported in the vertical direction. The supporting surface makes it possible to predetermine a defined position for the refill container in the accommodating well. All that is necessary for this purpose is for the refill container to be inserted into the accommodating well such that it can be supported on the supporting surface of the accommodating well. This makes it possible to avoid, or at least vastly reduce, movement of the refill container relative to the accommodating well.

It may be provided, for example, that the refill container widens, at a distance from the container opening, via a step which can be engaged against the supporting surface of the accommodating well.

In the case of a constructionally particularly simple configuration of the accommodating well, the supporting surface is formed by a free periphery of the accommodating well. In the case of such an embodiment, the refill container inserted into the accommodating well projects, in part, out of the accommodating well, and it has an externally disposed step seated on the periphery of the accommodating well. The refill container is thus accessible to the user at all times. In particular, it may be provided that the refill container forms, in the region projecting out of the accommodating well, a hand grip, for gripping the refill container, for example a dished gripping portion or a handle which can be gripped by the user.

It may be provided that the refill container is enclosed over its entire circumference by the wall of the accommodating well, said refill container engaging against the well wall at least in certain regions.

In the case of a preferred configuration, the well wall has an opening in which the refill container inserted into the accommodating well engages by way of a lateral widened portion. This assists the vibration-resistant securing of the refill container in the accommodating well and, furthermore, ensures that the refill container has a predetermined orientation in the accommodating well, namely such that the lateral widened portion of the refill container engages in the opening in the well wall. The opening may be configured, for example, as a depression, in particular as a groove-like depression, or else as a gap in the wall of the well.

It is advantageous if the lateral widened portion of the refill container can be seen from the outside by the user through the opening in the well wall. This makes it easier for the user to monitor the position of the refill container in the accommodating well, since the refill container can be seen through the opening in the wall of the well. The opening may be, for example, transparent. In particular, it is possible for the opening to be in the form of a gap in the wall of the well, so that the refill container is directly accessible to the user in the region of the lateral widened portion.

It is particularly advantageous if the refill container is transparent at least in the region of the lateral widened portion, since the user can thus easily see the filling level of the refill container.

A marking, from which the filling level can be read, is preferably disposed in the region of the lateral widened portion. This makes it easier to monitor the filling level, wherein the user can read the filling level directly from the marking of the refill container.

As already mentioned in the introduction, the storage and dispensing system according to the invention has a dispensing device, with the aid of which liquid cleaning additive can be withdrawn in a controlled manner from the intermediate tank, in order to mix the cleaning additive with the cleaning liquid of the high-pressure cleaning appliance. In the case of an advantageous configuration of the invention, the dispensing device comprises a solenoid valve which is connected to an outlet of the intermediate tank. The solenoid valve can preferably be controlled in a cyclic manner, that is to say it can be opened and closed repeatedly in a defined manner. With each opening operation, a defined quantity of liquid cleaning additive is drawn off from the intermediate tank. The withdrawal of a constant quantity of cleaning additive is assisted wherein the intermediate tank maintains a constant liquid level, in particular a completely full state, since, upon each withdrawal of liquid cleaning additive from the intermediate tank, a corresponding quantity of cleaning additive can flow in, out of the refill container. Ensuring a constant liquid level in the intermediate tank means that the controlled draw-off of cleaning additive from the intermediate tank can easily take place by means of a solenoid valve without additional measuring or delivery devices having to be used.

It is advantageous if a sensor can be used to sense when a filling level of the intermediate tank drops below a minimum value. An indicator can be used to indicate to the user optically or acoustically that the filling level has dropped below a minimum value.

In order to avoid the situation where a refill container with an unsuitable cleaning additive is used accidentally, so that the high-pressure cleaning appliance is possibly damaged, a particularly advantageous configuration of the storage and dispensing system according to the invention comprises a reader for contactlessly reading an electrical memory element disposed on the refill container. Such memory elements are known to a person skilled in the art in the form of so-called RFID tags (Radio Frequency Identification Tags). An electrical memory element of the refill container can store information relating to the liquid cleaning additive in the refill container, for example the chemical name and/or composition and/or production date thereof. This information can be read contactlessly by the reader and then evaluated by a control unit of the high-pressure cleaning appliance. The control unit can store the names of the cleaning additives which are suitable for the respective high-pressure cleaning appliance, so that the name read can be compared with the names stored. If it is not possible to establish any correspondence, this can be indicated to the user on a display unit of the high-pressure cleaning appliance, and furthermore, it may be provided that, in this case, the dispensing device of the storage and dispensing system is deactivated. It is thus reliably possible to avoid the situation where an unsuitable liquid cleaning additive is used.

It is particularly advantageous if the system has an electrical communication device, and if the refill container has disposed on it a read/write memory which can be contactlessly read from and written to by the communication device. In the case of such a configuration, it is possible not just to read from a memory element of the refill container, but also to write to the same. It is thus possible, for example, for information relating to the use of the refill container to be stored in the memory element thereof. In particular, the duration of use of the refill container can be detected and stored. It may also be provided that the quantity of liquid cleaning additive which has been withdrawn from the refill container, or is still located therein, is stored in the memory element. It is thus possible to read the memory element in order to determine the quantity of liquid cleaning additive which is still available.

The invention relates not just to the above-described system for storing and dispensing a liquid cleaning additive, but also to a refill container for such a system. The refill container is distinguished wherein it has a container opening which is formed by an outlet nozzle and, in the filled state of the refill container, is sealed closed by a film material or membrane, and wherein the refill container can be inserted into an accommodating well of the system with its outlet nozzle directed vertically downward and with the sealed closure thereof being maintained, and positive locking being established in the process, it being possible for the film material or membrane to be cut through by virtue of the outlet nozzle being positioned on the connection nozzle disposed on the base of the accommodating well. As already explained, such a configuration of the refill container makes it possible for the latter to be easily inserted into the accommodating well and flow-connected to the intermediate tank, the refill container being opened only when its outlet nozzle is disposed directly above the connection nozzle. The film material or membrane disposed on the outlet nozzle is then cut through by the cutting edge disposed on the connection nozzle and cleaning additive can flow into the intermediate tank as required.

The refill container according to the invention can be inserted in a positively locking manner into the accommodating well, so that the refill container executes virtually no lateral movement during the operation of the high-pressure cleaning appliance; rather, it is held reliably in the accommodating well, and liquid cleaning additive can flow out of the refill container into the intermediate tank solely under the action of gravitational force, without the use of any delivery subassemblies, the quantity flowing in corresponding to the quantity drawn off from the intermediate tank. It is thus possible to maintain the liquid level in the intermediate tank. In particular the refill container according to the invention ensures that the intermediate tank remains constantly completely full. As already explained, this makes it easier to withdraw a controlled quantity of liquid cleaning additive from the intermediate tank without measuring or delivery means having to be used; rather, draw-off can take place by means of a solenoid valve. The refill container has a container base and a container top, which are connected integrally to one another via a container wall, the outlet nozzle projecting from the container top. The outlet nozzle is preferably disposed centrally on the container top, as seen in plan view.

It is advantageous if the refill container is transparent at least in a wall region which extends from the container top to the container base, because this makes it easier for a user to monitor the fill level of the refill container.

It may be provided that the container wall forms a transparent lateral widened portion. The lateral widened portion makes it possible for the user to insert the refill container with defined orientation into an accommodating well of the high-pressure cleaning appliance. The transparent configuration of the lateral widened portion allows the level of filling to be monitored directly.

It is advantageous here if a marking is disposed in the region of the transparent lateral widened portion, so that the user can read the filling level of the refill container.

It is advantageous if the refill container tapers conically in the direction of the outlet nozzle. Tapering of less than 5° has proven to be particularly advantageous here.

In a preferred configuration, the refill container forms, at a distance from the outlet nozzle, a step which extends in the circumferential direction over an angular extent of at least 180°, in particular over an angular extent of more than 270°.

It may be provided that the refill container and the accommodating well have a substantially rectangular inner contour. A step which runs externally around the refill container can extend over at least three outer sides of the rectangular refill container. The step may be followed, in the direction away from the outlet nozzle, by a grip region, by which the user can easily grip the refill container, to be precise even when the refill container is inserted into the accommodating well of the high-pressure cleaning appliance. The grip region may have, in particular, a dished gripping portion, which makes it easier to grip the refill container.

In the case of an advantageous configuration, the internal diameter of the outlet nozzle is, at most, 36 mm. It has been found that, in the case of such dimensioning of the outlet nozzle, the uniform flow of liquid cleaning additive out of the refill container into the intermediate tank is ensured without the aid of additional delivery devices.

In the case of a preferred embodiment of the refill container according to the invention, the length of the outlet nozzle is, at most 24 mm. Such a length ensures that, when liquid cleaning additive flows out of the refill container, air can pass readily into the refill container, so that cleaning additive can flow out continuously in order to maintain a constant liquid level in the intermediate tank.

The invention further relates to a high-pressure cleaning appliance having a pump for delivering a cleaning liquid and having a system for storing and dispensing a liquid cleaning additive, of the type explained above, it being possible for the cleaning additive to be admixed with the cleaning liquid. It is advantageous here if the cleaning additive can be admixed with the cleaning liquid upstream of the pump, that is to say if admixing takes place even before the cleaning liquid is subjected to pressure.

The high-pressure cleaning appliance preferably has a heatable heat exchanger for heating the cleaning liquid subjected to pressure by the pump.

The high-pressure cleaning appliance is preferably mobile.

It is advantageous if a descaling solution can be admixed with the cleaning liquid by means of the storage and dispensing system explained above.

The following description of a preferred embodiment will be used to give a more detailed explanation in conjunction with the drawing.

DETAILED DESCRIPTION OF THE INVENTION

Figure 1:
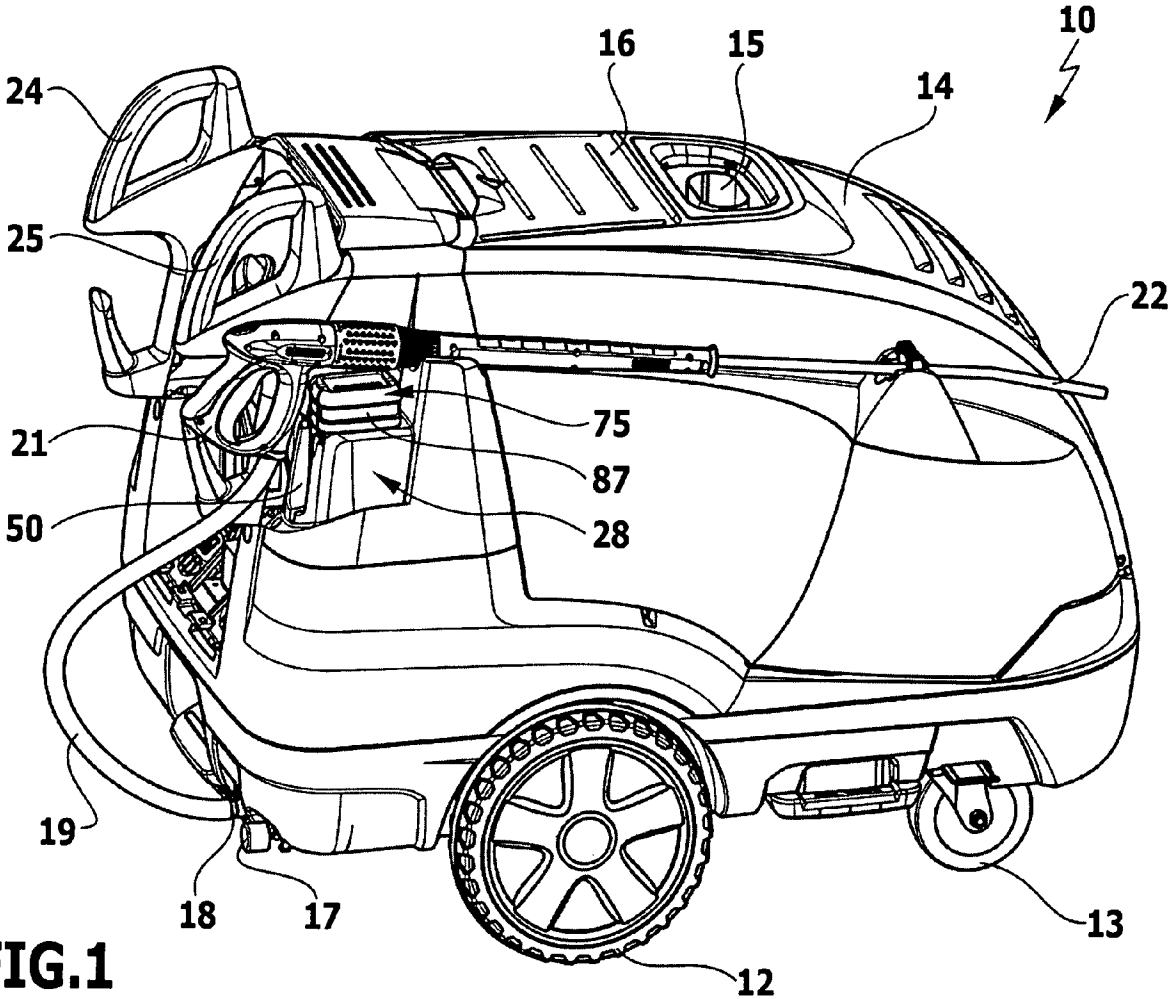
FIG. 1 shows a perspective illustration of a high-pressure cleaning appliance having a storage and dispensing system for liquid cleaning additive.
Figure 2:
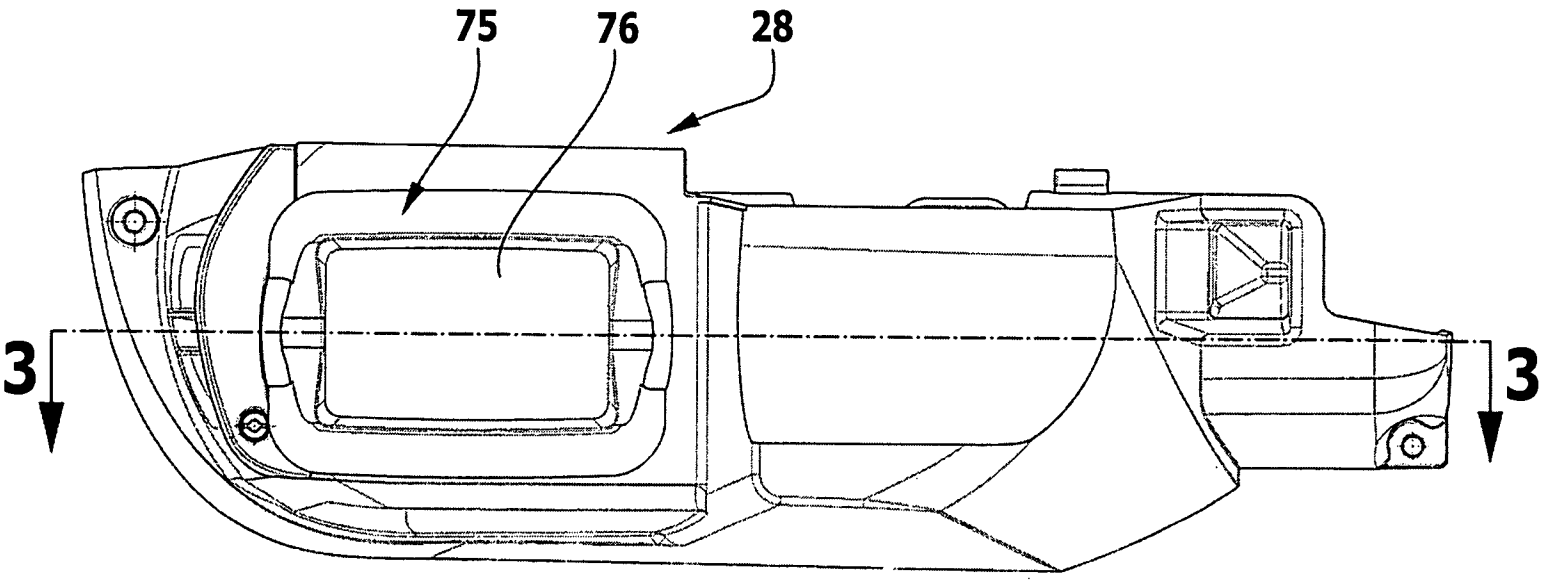
FIG. 2 shows a plan view of the storage and dispensing system.
Figure 3:
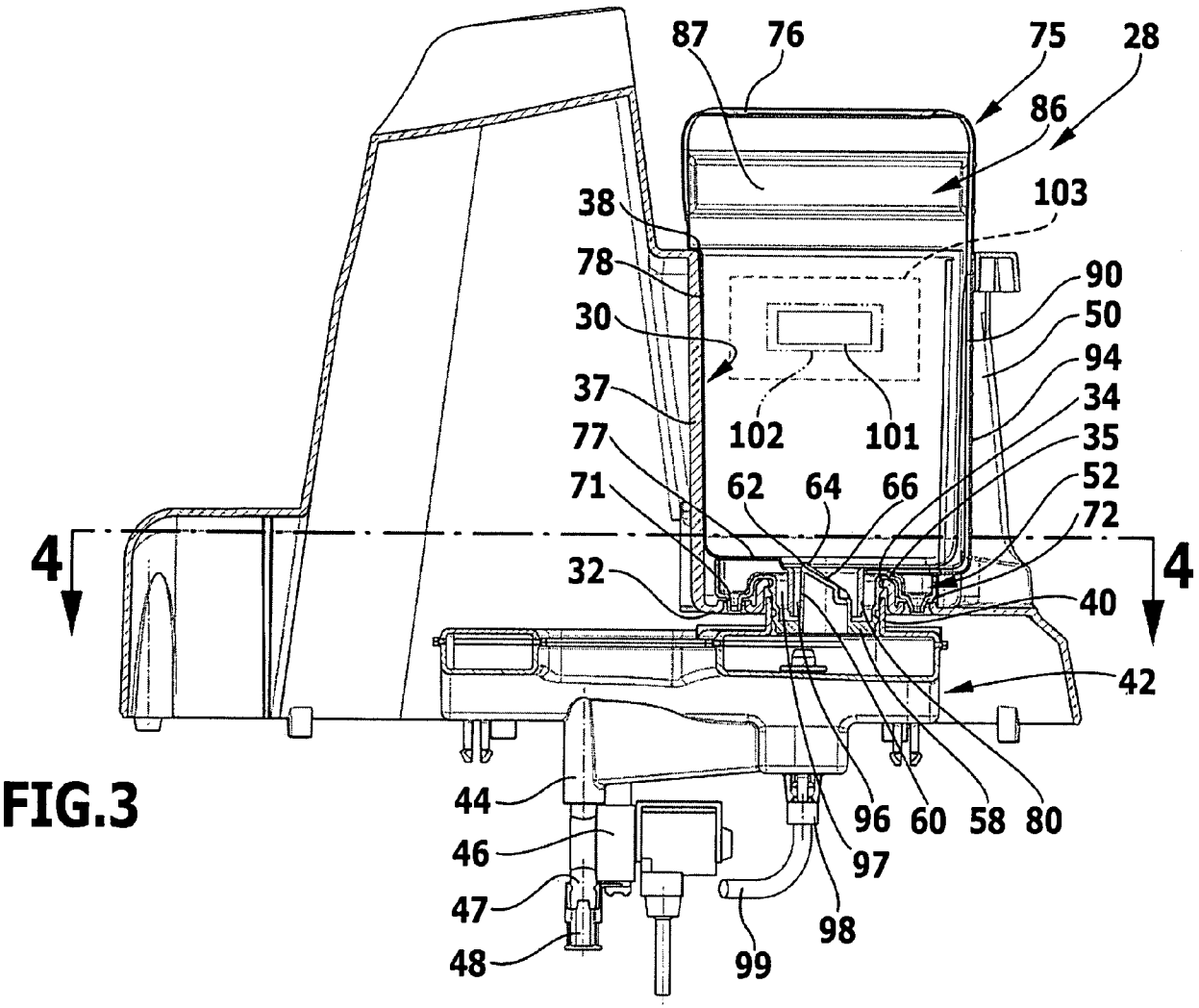
FIG. 3 shows a sectional view along line 3-3 in FIG. 2.
Figure 4:
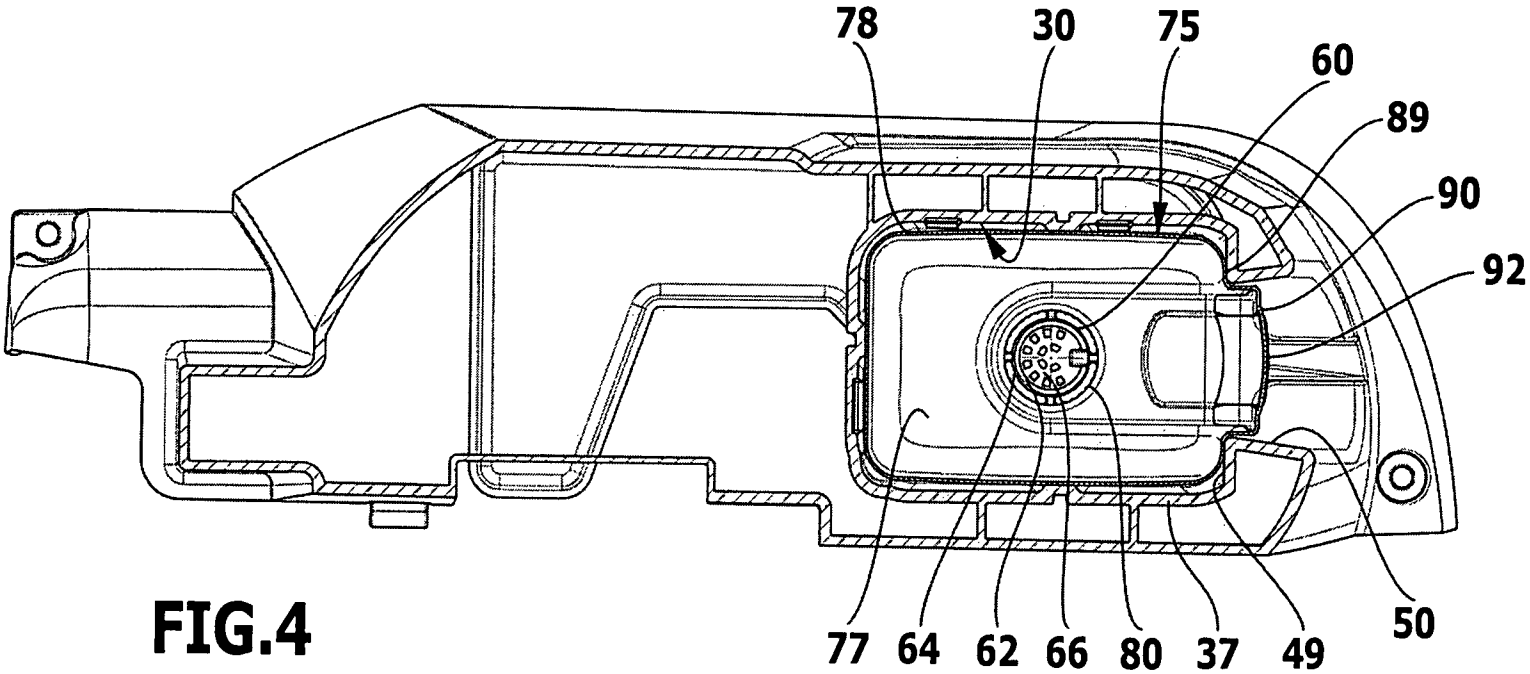
FIG. 4 shows a sectional view along line 4-4 in FIG. 3.

FIG. 1 illustrates, schematically, a high-pressure cleaning appliance 10 which, in the embodiment illustrated, is mobile and, for this purpose has running wheels, it being possible to see a rear running wheel 12 and a front running wheel 13 in the drawing. A housing 14 has disposed within it, in a manner which is known per se and cannot be seen from the drawing, a high-pressure pump and a heat exchanger, which is disposed downstream of the high-pressure pump. The heat exchanger is heated by a burner. The flue pipe 15 of the burner is disposed on the upper side 16 of the housing 14. A cleaning liquid, in particular water, can be fed to the high-pressure pump via a low-pressure infeed 17, the cleaning liquid then being subjected to pressure by the high-pressure pump and being delivered via a high-pressure outlet 18. A delivery device with a spray gun 21 and a spray lance 22, which is connected to the spray gun, is connected to the high-pressure exit 18 via a high-pressure hose 19.

For transportation purposes, the heatable high-pressure cleaning appliance 10 can be maneuvered by an operator by way of two handles 24, 25.

Laterally alongside the handle 25, the housing 14 has disposed on it a storage and dispensing system 28, with the aid of which a liquid cleaning additive, for example a descaling solution, can be admixed in a controlled manner with the cleaning liquid. The construction of the storage and dispensing system 28 is evident, in particular, from FIGS. 2 to 5. This system comprises an accommodating well 30 with a substantially rectangular inner contour. The accommodating well 30 has a well base 32 that has a central filling opening 34 with an opening periphery 35 running around the same. The well base 32 is adjoined integrally by a well wall 37 which, at its end which is directed away from the well base 32, merges into the contour of the housing 14 via a supporting surface 38, which runs parallel to the well base 32.

The filling opening 34 is aligned with a filling nozzle 40 of an intermediate tank 42 which is disposed beneath the accommodating well 30 and has, at a vertical distance from the filling nozzle 40, an outlet channel 44, to which is connected a dispensing device in the form of an electrically controllable solenoid valve 46. The solenoid valve 46 is adjoined by an outlet line 47 which is provided with a fine filter 48 and via which a liquid cleaning additive, in particular a descaling solution, can be drawn off from the intermediate tank 42, it then being possible for this solution to be admixed, upstream of the high-pressure pump, with the cleaning liquid, which can be subjected to pressure, of the high-pressure cleaning appliance 10.

The well wall 37 has, on a narrow side 49, an opening in the form of a gap 50. The gap 50 is positioned at the rear of the high-pressure cleaning appliance 10, so that it can readily be seen by the user maneuvering the high-pressure cleaning appliance 10 by the handles 24, 25.

Figure 5:
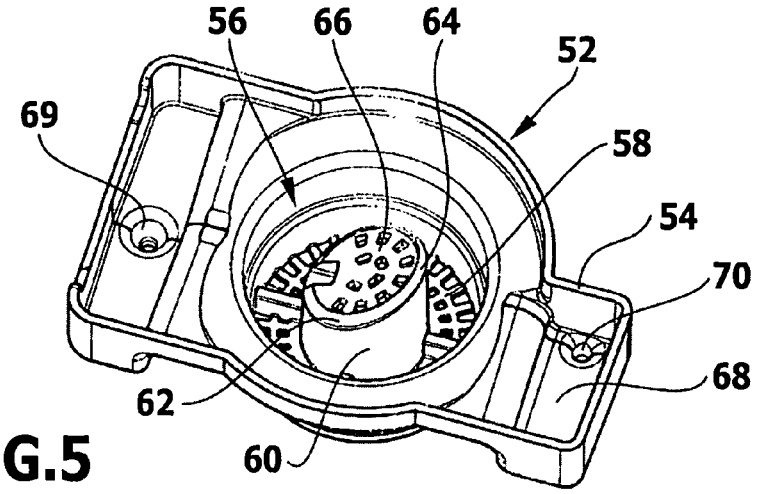
FIG. 5 shows a perspective illustration of an insert of the storage and dispensing system.

The accommodating well 30 has inserted into it an insert 52, which is illustrated schematically in FIG. 5 and is seated on the well base 32. It is formed in the manner of a trough and comprises a circumferential trough periphery 54 and a central depression 56, which can be inserted into the filling opening 34 of the well base 32 to establish a releasable latching connection. The depression 56 penetrates into the filling nozzle 40 of the intermediate tank 42 and carries on its base, which is directed toward the intermediate tank, 42, a first screen 58 with a mesh width of approximately 1 mm. The first screen 58 can be seen in FIG. 5. The first screen 58 has formed onto it centrally, and thus coaxially in relation to the filling opening 34 and in relation to the filling nozzle 40, a connection nozzle 60, which carries a cutting edge 64 and a second screen 66 at its free end 62, which is directed toward the accommodating well 30. The mesh width of the second screen 66 is likewise approximately 1 mm. The second screen 66 can be seen, in particular, from FIG. 5.

The trough periphery 54 of the insert 52 encloses a stepped trough base 68 which, outside the central depression 56, has two discharge nipples 69, 70, which each engage through a respective tap-off opening 71, 72 of the accommodating well 30, each tap-off opening being formed in the well base 32 such that it is offset laterally in relation to the filling opening 34.

Figure 6:
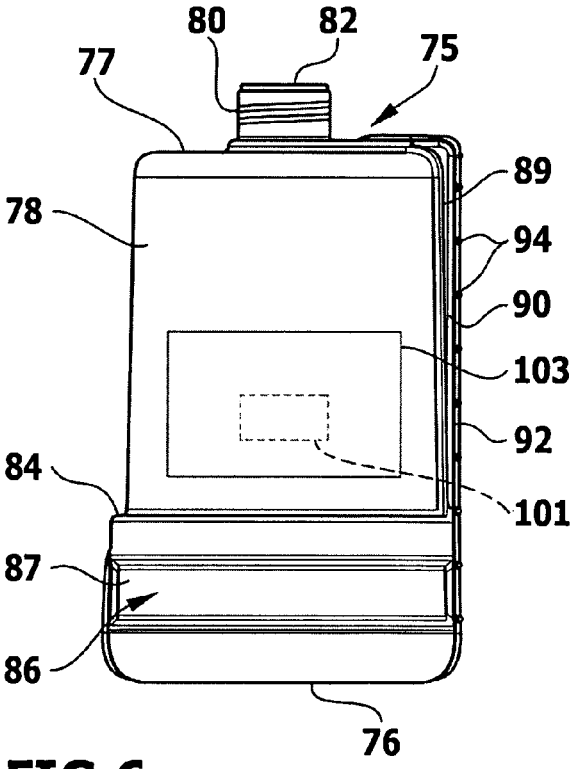
FIG. 6 shows a front view of a refill container of the storage and dispensing system.
Figure 7:
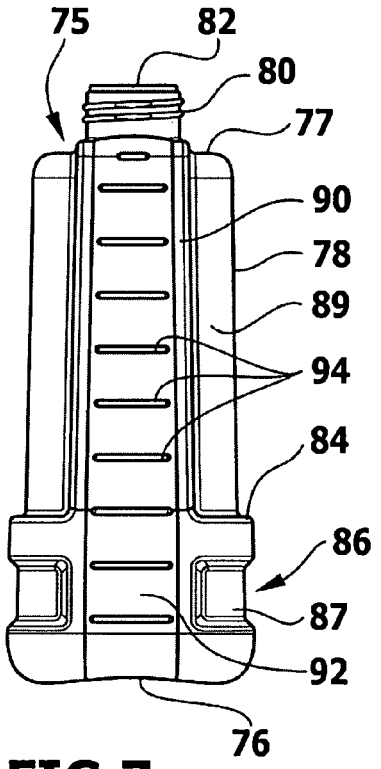
FIG. 7 shows a side view of the refill container from FIG. 6.

A refill container 75 which can be handled on a stand-alone basis, and is illustrated separately in FIGS. 6 and 7, is inserted in an upended state into the accommodating well 30. This refill container is substantially rectangulate and has a container base 76 and a container top 77, which are connected integrally to one another via a container wall 78. In a manner corresponding to the accommodating well 30, the refill container 75 is substantially rectangular in cross-section. It can be inserted into the accommodating well 30 to establish a positive lock. This is evident, in particular, from FIG. 3.

In the region of the container top 77, the refill container 75 has an outlet nozzle 80 which, when the refill container 75 has been filled, and before it is inserted into the accommodating well 30, is sealed closed by means of a film material 82.

The container wall 78 has, at a distance from the container base 76, an external step 84, and the container wall 78 tapers continuously in the region between the step 84 and the container top 77. In the region between the step 84 and the container base 76, the refill container 75 forms a grip region 86 with a dished gripping portion 87, which makes it easier for a user to grip the refill container 75.

On a narrow side 89, the refill container 75 has a widened portion 90, which extends to the container top 77. At least in the region of the widened portion 90, the refill container 75 is transparent from the container base 76 to the container top 77. In the region of the widened portion 90, the refill container 75 carries a marking 94, from which the user can read-off the filling level of the refill container 75.

The refill container 75 can be inserted in a positively locking manner into the accommodating well 30 in an upended state, that is to say with the outlet nozzle 80 directed toward the well base 32, this outlet nozzle initially still being sealed closed by means of the film material 82. In the course of this, the connection nozzle 60 of the insert 52 penetrates into the outlet nozzle 80 of the refill container 75, the film material 82 being cut through by the cutting edge 64 of the connection nozzle 60 as soon as, upon insertion of the refill container 75 into the accommodating well 30, the outlet nozzle 80 reaches the free end 62 of the connection nozzle 60.

The refill container 75 inserted into the accommodating well 30 is supported in the vertical direction in the region of the container top 77 by the trough periphery 54 of the insert 52. The refill container 75 is provided with additional support in the region of the step 84, which bears against the supporting surface 38 of the accommodating well 30.

In order to insert the refill container 75 into the accommodating well 30, it is necessary for the refill container 75 to be oriented such that its lateral widened portion 90 can penetrate into the gap 50 in the well wall 37. The transparent region 92 of the refill container 75 can thus readily be seen by the user, so that he can read-off the filling level of the refill container 75 from the marking 94.

The internal diameter of the outlet nozzle 80 is selected such that an inner annular space 96 is formed between the connection nozzle 60 and the outlet nozzle 80, and that an outer annular space 97 is formed between the outlet nozzle 80 and the periphery 35 of the filling opening 34. The external diameter of the connection nozzle is preferably 9 mm to 36 mm, in particular 20 mm. The internal diameter of the outlet nozzle 80 is preferably 13 mm to 38 mm, in particular 29 mm. The internal diameter of the filling opening 34 is preferably 15 mm to 63 mm, in particular 39 mm. The length of the outlet nozzle 80 is preferably 17 mm to 24 mm, in particular 22 mm.

The refill container 75 accommodates a liquid cleaning additive, for example a descaling solution. If the refill container 75, which is initially completely full, is inserted into the accommodating well 30, then cleaning additive can flow out of the refill container 75 into the intermediate tank 42. Cleaning additive flows out of the refill container only until the intermediate tank is completely full. The flow then ceases without additional shut-off elements being necessary. A further quantity of cleaning additive flows out of the refill container only when a corresponding quantity is withdrawn from the intermediate tank 42. The exchange of air which is necessary for liquid cleaning additive to flow out of the refill container 75 as required is ensured by the provision of the inner annular space 96 and of the outer annular space 97. It has been found that the liquid cleaning additive flows out of the refill container 75 preferably via the outer annular space 97, air passing simultaneously into the refill container 75 via the inner annular space 96. Air can collect beneath the second screen 66, which is disposed at the free end 62 of the connection nozzle 60, and this accumulated air can then pass into the refill container 75 via the second screen 66. If a certain quantity of liquid cleaning additive is withdrawn from the filled intermediate tank 42 by virtue of the solenoid valve 46 being opened briefly, then a corresponding quantity flows out of the refill container 75 into the intermediate tank 42, so that the intermediate tank 42, as long as there is still liquid cleaning additive in the refill container 75, assumes a uniformly filled state. This makes it easier for a defined quantity of liquid cleaning additive to be drawn off by means of the solenoid valve 46, by brief opening.

As already pointed out above, the user can read-off the filling level of the refill container 75, on the marking 94 in the region of the gap 50 of the accommodating well 30. If there is no longer any cleaning additive in the refill container 75, then the high-pressure cleaning appliance 10 can nevertheless continue to be operated for a certain period of time with cleaning additive being admixed with the cleaning liquid, the intermediate tank 42 then also emptying gradually. If a minimum level is reached in the intermediate tank, then this is sensed by a filling-level sensor 98 which dips into the intermediate tank 42 and is connected to a control unit of the high-pressure cleaning appliance 10 via an electric sensor line 99. The control unit may have an indicator which can indicate to the user that the minimum filling level of the intermediate tank 42 has been reached. The user can thus see that it is now no longer possible for any further liquid cleaning additive to be admixed with the cleaning liquid. It may then be provided, for example, that the burner of the heatable high-pressure cleaning appliance 10 is switched off, in order to avoid limescale building up on the appliance. The intermediate tank 42 can be refilled by virtue of a new refill container being inserted into the accommodating well 30, so that proper operation of the high-pressure cleaning appliance 10 is then possible again.

The refill container 75 carries, beneath a label 103 applied to the front thereof, an RFID tag 101 (Radio Frequency Identification Tag) with an electrical memory element, which is read-out by a reader 102 disposed on the outside of the wall 37 of the accommodating well 30, and can also be written to. For this purpose, a radio link can be made between the reader 102 and the RFID tag 101 through the well wall 37, which is formed from plastics material. The reader 102 is connected to the control unit of the high-pressure cleaning appliance 10 via a connecting line (not illustrated in the drawing). The memory element of the RFID tag can store information relating to the properties of the cleaning additive in the refill container 75, in particular the chemical composition thereof. This can thus be picked up by the reader 102 and transmitted to the control unit of the high-pressure cleaning appliance 10. A memory element of the control unit can store information relating to the cleaning additives which are suitable for the high-pressure cleaning appliance 10. It is thus possible for the information which is read from the RFID tag 101 to be compared with the information which is stored in the memory element of the control unit. Only if it is established that the cleaning additive in the refill container 75 is suitable for the high-pressure cleaning appliance 10 is it possible for a desired quantity of cleaning additive to be withdrawn from the intermediate tank 42 by means of the solenoid valve 46. If the cleaning additive is not suitable for the high-pressure cleaning appliance 10, then this is indicated to the user by the indicator of the control unit and the solenoid valve 42 remains in its closed state, so that the operation of admixing the cleaning additive to the cleaning liquid of the high-pressure cleaning appliance 10 is blocked.

The invention claimed is:

1. High-pressure cleaning appliance, comprising:

a pump for delivering a cleaning liquid, and a system for storing and dispensing a liquid cleaning additive, comprising:

a storage device for storing the cleaning additive, and a dispensing device for dispensing the cleaning additive in a controlled manner for mixing with the cleaning liquid, the storage device comprising an intermediate tank, which is adapted to be fixedly held on or in the high-pressure cleaning appliance, and an independently handlable refill container for filling the intermediate tank, wherein:

the dispensing device is adapted to withdraw the cleaning additive in a controlled manner from the intermediate tank, the refill container is adapted to be secured on or in the high-pressure cleaning appliance and flow-connected to the intermediate tank such that the cleaning additive automatically flows out of the refill container into the intermediate tank upon draw-off of the cleaning additive from the intermediate tank, in order to maintain a predetermined liquid level in the intermediate tank, the storage device has a holder with a base which comprises a filling opening via which the intermediate tank can be filled with the cleaning additive and which is surrounded by an opening periphery and in which a connection nozzle is disposed, the refill container comprises an outlet nozzle and is adapted to be inserted into the holder, the outlet nozzle adapted to be positioned on the connection nozzle with an inner annular space being formed between the connection nozzle and the outlet nozzle and an outer annular space being formed between the outlet nozzle and the opening periphery, and an insert is disposed in the holder, the insert having a first screen that can be inserted into the filling opening and on which the connection nozzle is held.

2. High-pressure cleaning appliance according to claim 1, wherein the connection nozzle has, at an end which is directed toward the refill container, a cutting edge for cutting through a film material or membrane which closes the outlet nozzle.

3. High-pressure cleaning appliance according to claim 1, wherein the end of the connection nozzle directed toward the refill container runs obliquely in relation to a longitudinal axis of the connection nozzle.

4. High-pressure cleaning appliance according to claim 1, wherein the connection nozzle is surrounded by the first screen.

5. High-pressure cleaning appliance according to claim 4, wherein the connection nozzle has a second screen.

6. High-pressure cleaning appliance according to claim 5, wherein the second screen is offset in a direction of the refill container in relation to the first screen.

7. High-pressure cleaning appliance according to claim 5, wherein the second screen is disposed at the end of the connection nozzle which is directed toward the refill container.

8. High-pressure cleaning appliance according to claim 1, wherein the insert is adapted to be connected in a releasable manner to the holder.

9. High-pressure cleaning appliance according to claim 1, wherein the insert is of trough-like configuration and comprises a trough periphery which is directed toward the refill container and on which the refill container can be supported.

10. High-pressure cleaning appliance according to claim 1, wherein:

at least one tap-off opening is disposed on the base of the holder, and the insert has at least one discharge opening interacting with the tap-off opening.

11. High-pressure cleaning appliance according to claim 10, wherein the discharge opening is formed by a discharge nipple which penetrates into the tap-off opening.

12. High-pressure cleaning appliance according to claim 1, wherein the holder comprises:

an accommodating well with a well wall, wherein the base comprises a well base, the filling opening for filling the intermediate tank is disposed on the well base, and the refill container is adapted to be inserted into the accommodating well by way of a container opening formed by the outlet nozzle which is directed toward the filling opening, the refill container engaging against the well wall at least in certain regions.

13. High-pressure cleaning appliance according to claim 12, wherein the refill container inserted into the accommodating well is retained in the accommodating well with the container opening oriented downward and such that the refill container cannot be displaced transversely to a vertical direction.

14. High-pressure cleaning appliance according to claim 12, wherein the accommodating well has a supporting surface, on which the refill container can be supported in a vertical direction.

15. High-pressure cleaning appliance according to claim 14, wherein the refill container widens, at a distance from the container opening, via a step which is adapted to be engaged against the supporting surface of the accommodating well.

16. High-pressure cleaning appliance according to claim 14, wherein the supporting surface is formed by a free periphery of the accommodating well.

17. High-pressure cleaning appliance according to claim 12, wherein the well wall has an opening in which the refill container inserted into the accommodating well engages by way of a lateral widened portion.

18. High-pressure cleaning appliance according to claim 17, wherein the lateral widened portion is adapted to be seen by a user through the opening.

19. High-pressure cleaning appliance according to claim 17, wherein the refill container is transparent at least in a region of the lateral widened portion.

20. High-pressure cleaning appliance according to claim 19, wherein a marking, from which a filling level of the refill container can be read, is disposed in the region of the lateral widened portion.

21. High-pressure cleaning appliance according to claim 1, wherein the dispensing device comprises a solenoid valve which is connected to an outlet of the intermediate tank.

22. High-pressure cleaning appliance according to claim 1, wherein the dispensing device comprises a sensor which is adapted to sense when a filling level of the intermediate tank drops below a minimum value.

23. High-pressure cleaning appliance according to claim 1, wherein the system comprises a reader for contactlessly reading an electrical memory element disposed on the refill container.

24. High-pressure cleaning appliance according to claim 1, wherein:

the system further comprises an electrical communication device, and the refill container has disposed on it a read/write memory which is adapted to be contactlessly read from and written to by the communication device.

25. High-pressure cleaning appliance according to claim 1, wherein:

the refill container has a container opening which is formed by the outlet nozzle and, in a filled state of the refill container, is sealed closed by a film material or membrane, the refill container is adapted to be inserted into an accommodating well of the holder with the outlet nozzle directed vertically downward and with the sealed opening thereof being maintained, a positive locking being established in the process, the film material or membrane is adapted to be cut through by virtue of the outlet nozzle being positioned on the connection nozzle.

26. High-pressure cleaning appliance according to claim 25, wherein the refill container has a container base and a container top, which are connected integrally to one another via a container wall from which the outlet nozzle projects, the refill container being transparent at least in a wall region, which extends from the container top to the container base.

27. High-pressure cleaning appliance according to claim 26, wherein the container wall has a transparent lateral widened portion.

28. High-pressure cleaning appliance according to claim 25, wherein the refill container tapers conically in a direction of the outlet nozzle.

29. High-pressure cleaning appliance according to claim 25, wherein the refill container forms, at a distance from the outlet nozzle, a step which extends in a circumferential direction over an angular extent of at least 180°.

30. High-pressure cleaning appliance according to claim 25, wherein an internal diameter of the outlet nozzle is, at most, 36 mm.

31. High-pressure cleaning appliance according to claim 25, wherein a length of the outlet nozzle is, at most, 24 mm.

32. High-pressure cleaning appliance according to claim 1, wherein the cleaning liquid is heatable.

33. High-pressure cleaning appliance according to claim 1, wherein the high-pressure cleaning appliance is mobile.

* * * * *